US010550868B2

(12) United States Patent
Vigholm

(10) Patent No.: US 10,550,868 B2
(45) Date of Patent: Feb. 4, 2020

(54) LOAD SENSING HYDRAULIC SYSTEM FOR A WORKING MACHINE, AND A METHOD FOR CONTROLLING A LOAD SENSING HYDRAULIC SYSTEM

(71) Applicant: VOLVO CONSTRUCTION EQUIPMENT AB, Eskilstuna (SE)

(72) Inventor: Bo Vigholm, Stora Sundby (SE)

(73) Assignee: VOLVO CONSTRUCTION EQUIPMENT AB, Eskilstuna (SE)

( * ) Notice: Subject to any disclaimer, the term of this patent is extended or adjusted under 35 U.S.C. 154(b) by 258 days.

(21) Appl. No.: 15/565,154

(22) PCT Filed: Apr. 10, 2015

(86) PCT No.: PCT/SE2015/050425
§ 371 (c)(1),
(2) Date: Oct. 7, 2017

(87) PCT Pub. No.: WO2016/163926
PCT Pub. Date: Oct. 13, 2016

(65) Prior Publication Data
US 2018/0100525 A1 Apr. 12, 2018

(51) Int. Cl.
*F15B 21/00* (2006.01)
*F15B 21/14* (2006.01)
(Continued)

(52) U.S. Cl.
CPC ..... *F15B 21/14* (2013.01); *E02F 9/2221* (2013.01); *F15B 11/165* (2013.01);
(Continued)

(58) Field of Classification Search
CPC ..... F15B 2211/605; F15B 2211/6051; F15B 2211/6052; F15B 2211/6054;
(Continued)

(56) References Cited

U.S. PATENT DOCUMENTS 5,044,256 A * 9/1991 Budzich ..... E02F 9/226 137/596.1
5,046,309 A 9/1991 Yoshino
(Continued)

FOREIGN PATENT DOCUMENTS

GE 2134187 A 8/1984

OTHER PUBLICATIONS

International Search Report (dated Jan. 5, 2016) for corresponding International App. PCT/SE2015/050425.

*Primary Examiner* — Thomas E Lazo
*Assistant Examiner* — Dustin T Nguyen
(74) *Attorney, Agent, or Firm* — Sage Patent Group

(57) ABSTRACT

A hydraulic system for a working machine is a load sensing system and includes a hydraulic actuator for movement of an implement and a control valve having an inlet valve and an outlet valve for controlling the flow of hydraulic fluid from a pump to the hydraulic actuator and for draining hydraulic fluid from the hydraulic actuator, respectively. The hydraulic system also includes an arrangement for determining the load on the hydraulic actuator. The hydraulic system further includes a valve for disconnecting the flow of hydraulic fluid from the pump to the hydraulic actuator, while allowing another flow of hydraulic fluid to the hydraulic actuator, provided that the determined load on the hydraulic actuator exceeds a threshold value.

13 Claims, 4 Drawing Sheets

(51) Int. Cl.
*F15B 11/16* (2006.01)
*E02F 9/22* (2006.01)

(52) U.S. Cl.
CPC ..... *F15B 2211/20553* (2013.01); *F15B 2211/30515* (2013.01); *F15B 2211/6057* (2013.01); *F15B 2211/6313* (2013.01); *F15B 2211/6346* (2013.01); *F15B 2211/6652* (2013.01); *F15B 2211/761* (2013.01); *F15B 2211/88* (2013.01)

(58) Field of Classification Search
CPC ..... F15B 2211/6055; F15B 2211/6058; F15B 2211/65; F15B 2211/651; F15B 2211/652; F15B 2211/653; F15B 2211/654; F15B 2211/30515; F15B 2211/6313; F15B 2211/20553; F15B 2211/20546; F15B 13/0417; E02F 9/2221; E02F 9/2232
See application file for complete search history.

(56) References Cited

U.S. PATENT DOCUMENTS

| | | | | |
|---|---|---|---|---|
| 6,460,623 | B1 * | 10/2002 | Knussman ..... | A01B 63/11 111/926 |
| 7,089,733 | B1 * | 8/2006 | Jackson ..... | F15B 11/165 60/422 |
| 2003/0230082 | A1 | 12/2003 | Wook | |
| 2005/0051024 | A1 | 3/2005 | Nielsen et al. | |
| 2006/0162543 | A1 | 7/2006 | Abe et al. | |
| 2009/0199552 | A1 | 8/2009 | Abe et al. | |
| 2010/0236234 | A1 | 9/2010 | Andersson | |
| 2013/0298541 | A1 | 11/2013 | Carlin et al. | |
| 2014/0366951 | A1 | 12/2014 | Vigholm et al. | |

* cited by examiner

LOAD SENSING HYDRAULIC SYSTEM FOR A WORKING MACHINE, AND A METHOD FOR CONTROLLING A LOAD SENSING HYDRAULIC SYSTEM

BACKGROUND AND SUMMARY

The invention relates to a hydraulic system for a working machine. The hydraulic system is a load sensing (LS) system and comprises a hydraulic actuator for movement of an implement and a control valve having an inlet valve and an outlet valve for controlling the flow of hydraulic fluid from a pump to the hydraulic actuator, and for draining hydraulic fluid from the hydraulic actuator. The system also comprises a means for determining the load on the hydraulic actuator. The invention also relates to a method and a control unit for controlling a hydraulic system.

The invention can be applied on different types of hydraulic system, for example hydraulic systems for operating hydraulic cylinders for lifting an arm or tilting an implement of a wheel loader or for operating hydraulic cylinders for a dump body of an articulated hauler.

Although the invention will be described with respect to a hydraulic system for a wheel loader, the application of the invention is not restricted to this particular application, but may also be used in other hydraulic systems and vehicles.

A working machine is usually provided with a bucket, container or other type of implement for digging, lifting, carrying and/or transporting a load.

For example, a wheel loader has a lift arm unit for raising and lowering an implement, such as a bucket. The lift arm unit comprises hydraulic cylinders for movement of a load arm and the implement attached to the load arm. Usually a pair of hydraulic cylinders is arranged for raising the load arm and a further hydraulic cylinder is arranged for tilting the implement relative to the load arm.

In addition, the working machine is often articulated frame-steered and has a pair of hydraulic cylinders for turning/steering the working machine by pivoting a front section and a rear section of the working machine relative to each other.

The hydraulic system generally further comprises at least one hydraulic pump, which is arranged to supply hydraulic power, i.e. hydraulic flow and/or hydraulic pressure, to the hydraulic cylinders. The hydraulic pump is driven by a power source, such as an internal combustion engine or an electric motor. The hydraulic system of a working machine is usually a so called load sensing system (LS-system). This means that the pump that provides the actuators with hydraulic fluid receives a signal representing the current load pressure of a hydraulic cylinder in operation. The pump is then controlled to provide a pressure which is somewhat higher than the load pressure of the hydraulic cylinder.

The hydraulic pump is often a variable displacement pump that is driven by the prime mover of the working machine. If the pump is driven by an internal combustion engine, the pump is connected to a power take-off which can be located between the internal combustion engine and a transmission arrangement, such as a gear box. The transmission arrangement is in turn connected to e.g. wheels of the working machine for the propulsion thereof.

When driving a hydraulic cylinder in an LS-system, hydraulic oil is supplied by a pump and the flow of hydraulic oil from the pump is directed by an inlet valve to one side of the hydraulic cylinder and the flow of hydraulic oil from the other side of the hydraulic cylinder is drained to tank by an outlet valve.

The inlet valve and the outlet valve can be integrated in the same spool of a control valve. This means that when the valve is controlled to connect the pump to the piston rod side of the hydraulic cylinder, the piston side of the hydraulic cylinder is connected to tank, and when the pump is connected to the piston side of the hydraulic cylinder, the piston rod side of the hydraulic cylinder is connected to tank. This gives a robust system and relatively low costs.

A disadvantage with such a system is however that the pump is always supplying hydraulic oil to the hydraulic cylinder also during operations where there is no need for the pump to drive the hydraulic cylinder. For example when lowering a load, the mass of the load would often be sufficient to achieve the lowering movement without any pressure generated by the pump. This in turn means that during certain operations energy losses (increased fuel consumption) occur due to the use of the hydraulic pump even if no pump work is needed by the hydraulic cylinders.

An object of the invention is to provide a hydraulic system, by which system the energy losses and thereby the fuel consumption can be reduced.

The invention is based on the insight that by the provision of a hydraulic system that comprises a valve for disconnecting the flow of hydraulic fluid from the pump to the hydraulic actuator, while allowing another flow of hydraulic fluid to the hydraulic actuator, provided that a determined load on the hydraulic actuator exceeds a threshold value, the energy losses can be reduced due to the fact that the pump must not be driven when no pump work is required or the pump can be used for another hydraulic function.

For example, during lowering of a load when the pump is connected to the piston rod side of a hydraulic cylinder by means of the inlet valve, and the piston side of the hydraulic cylinder is drained by means of the outlet valve, the pump can be cut off by means of the disconnecting valve, while hydraulic fluid required for filling the piston rod side of the hydraulic cylinder is available from the return line and/or tank, and the piston rod of the hydraulic cylinder can be moved due to the mass of the load on the actuator. The load on the actuator can be caused by the actual mass of the load (in a bucket) to be lowered and/or the dead load (mass of bucket and/or lift arm).

According to one embodiment of the invention, the hydraulic system comprises a load holding valve arranged downstream the control valve and upstream the actuator with respect to the flow direction from the pump to the hydraulic actuator, and said valve for disconnecting the flow of hydraulic fluid from the pump to the hydraulic actuator is arranged to provide a pilot pressure to the load holding valve, thereby closing the load holding valve and disconnecting the pump. Hereby a disconnection valve working with relatively low flow of hydraulic fluid can be used for controlling the load holding valve working with a relatively high flow of hydraulic fluid to the actuator. Since such a load holding valve is very often used in this type of hydraulic system, no additional full flow valve has to be added.

According to a further embodiment of the invention, the system comprises a valve for preventing an LS-signal based on the load on the hydraulic actuator from reaching the pump when the pump is disconnected. Hereby, when the flow of hydraulic fluid from the pump to the hydraulic actuator is disconnected, the pump can be controlled to provide a lower (stand by) pump pressure by changing the displacement of the pump. Alternatively, the pump may receive an LS-signal from another actuator for supplying the pressure required for this actuator.

Preferably, the valve for preventing an LS-signal based on the load on the hydraulic actuator from reaching the pump when the pump is disconnected and said valve for disconnecting the flow of hydraulic fluid from the pump to the hydraulic actuator provided that a determined load on the hydraulic actuator exceeds a threshold value, is one and the same valve. Hereby, a cost effective system where the pump can be disconnected at the same time as the LS-signal is prevented from reaching the pump can be achieved.

According to a further embodiment of the invention, the load determining means comprises a pressure sensor arranged for measuring a hydraulic pressure indicating the load pressure of the hydraulic actuator. Hereby, the load on the hydraulic actuator can be determined and compared to the threshold value for deciding whether or not the flow of hydraulic fluid from the pump to the hydraulic actuator is to be disconnected.

According to a further embodiment of the invention, the threshold value for the load on the hydraulic actuator is calculated based on a signal indicating requested velocity of the hydraulic actuator. Hereby, the disconnection of the pump is not only dependent on the actual load on the actuator, but also on the requested velocity, preferably such that for a relatively low requested velocity of the actuator the load threshold value is lower than the load threshold value for a relatively high requested velocity of the actuator.

According to a further aspect, the invention relates to a method for controlling a hydraulic system.

According to a further aspect, the invention relates to a control unit for controlling a hydraulic system.

The same advantages as discussed above with reference to the hydraulic system can be reached by the method and the control unit according to the invention. Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples.

In the drawings.

DETAILED DESCRIPTION

Figure 1:
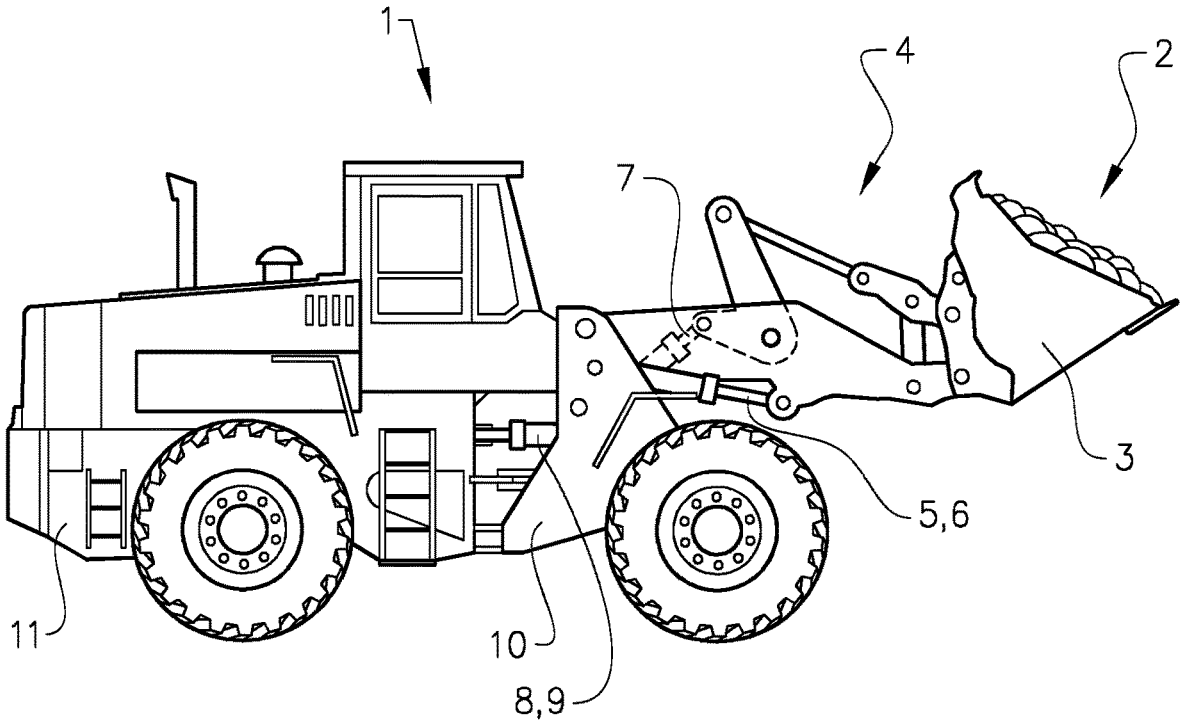
FIG. 1 is a lateral view illustrating a wheel loader having a hydraulic system according to the invention.

FIG. 1 is an illustration of a working machine 1 in the form of a wheel loader. The wheel loader is an example of a working machine where a hydraulic system according to the invention can be applied.

The wheel loader has an implement 2. The term "implement" is intended to comprise any kind of tool controlled by hydraulics, such as a bucket, a fork or a gripping tool. The implement illustrated is a bucket 3 which is arranged on a load arm 4 for lifting and lowering the bucket 3, and further the bucket can be tilted relative to the load arm. In the example embodiment illustrated in FIG. 1 a hydraulic system of the wheel loader comprises two hydraulic cylinders 5, 6 for the operation of the load arm 4 and one hydraulic cylinder 7 for tilting the bucket 3 relative to the load arm 4. Hereinbelow, the dead load of the implement (when unloaded) is mentioned. It should be noted that for a wheel loader also the load arm may contribute to the total dead load of the entire lift arrangement and thereby to the load on the actuator.

The hydraulic system of the wheel loader further comprises two hydraulic cylinders 8, 9, steering cylinders, arranged on opposite sides of the wheel loader 1 for turning the wheel loader by means of relative movement of a front body part 10 and a rear body part 11.

In other words; the wheel loader is articulated frame-steered by means of the steering cylinders 8, 9. There is a pivot joint connecting the front body part 10 and the rear body part 11 of the wheel loader 1 such that these parts are pivotally connected to each other for pivoting about a substantially vertical axis.

Figure 2:
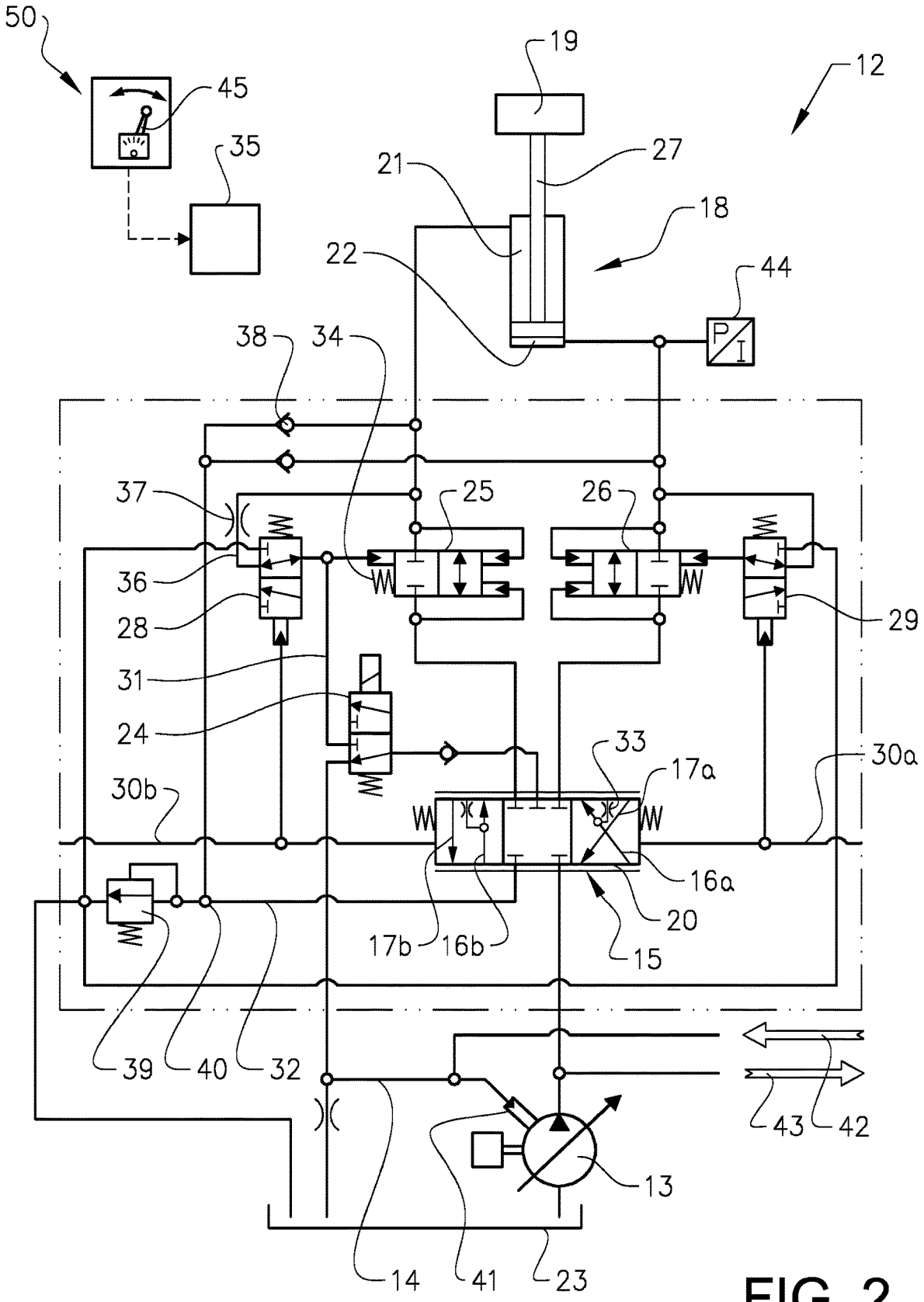
FIG. 2 shows one embodiment of the hydraulic system according to the invention.

One example embodiment of the hydraulic system 12 according to the invention is illustrated in FIG. 2. The hydraulic system 12 is a load sensing (LS) system. A pump 13 may supply one or more functions with hydraulic fluid. The pump 13 is controlled based on the highest LS-signal 14, 42 from a function that is active and thus has the highest load pressure. The pump 13 will then provide the hydraulic system with a pressure that is higher than the highest load pressure, i.e. a pressure that is the load pressure plus an offset, which offset can be about 20 bar.

By hydraulic fluid means hydraulic oil or any other corresponding fluid suitable for a hydraulic system.

The system comprises a control valve 15 having an inlet valve 16*a*, 16*b* and an outlet valve 17*a*, 17*b* for controlling the flow of hydraulic fluid from the pump 13 to a hydraulic actuator 18 and for draining hydraulic fluid from the hydraulic actuator 18, respectively. The actuator 18 is arranged for movement of an implement and exemplified by a hydraulic cylinder. The hydraulic cylinder 18 is subjected to a load 19. For example, the hydraulic cylinder 18 can be used for lifting an arm or a boom or for tilting an implement of a working machine. Of course, the actuator 18 could comprise two or more hydraulic cylinders or any other type of hydraulic actuator or equipment could be used.

In the example embodiment illustrated in FIG. 2, the inlet valve 16*a*, 16*b* and the outlet valve 17*a*, 17*b* are integrated in the same spool of the control valve 15. This means that when the control valve 15 is controlled to connect the pump 13 to the piston rod side 21 of the hydraulic cylinder 18, the piston side 22 of the hydraulic cylinder 18 is at the same time connected to tank 23, and when the pump 13 is connected to the piston side 22 of the hydraulic cylinder 18, the piston rod side 21 of the hydraulic cylinder 18 is at the same time connected to tank 23.

The hydraulic system 12 further comprises a valve 24 for disconnecting the flow of hydraulic fluid from the pump 13 to the hydraulic actuator 18, while allowing another flow of hydraulic fluid to the hydraulic actuator 18, provided that a determined load 19 on the hydraulic actuator exceeds a threshold value. As illustrated in FIG. 2 the disconnection valve 24, for example an electrically controlled 3/2 valve (3 ports and 2 states), can be arranged to provide a pilot pressure 31 to a further valve 25 for disconnecting the pump 13.

The hydraulic system 12 has preferably load holding valves 25, 26 arranged to prevent the hydraulic cylinder 18 from going backwards if the pressure at the hydraulic cylinder 18 for some reason would be higher than the pump pressure. These load holding valves 25, 26 have low internal leakage which prevents the piston rod 27 from sinking when the piston rod 27 is standing still and subjected to a load 19.

The load holding valves 25, 26 are activated by load holding pilot valves 28, 29. The load holding pilot valves 28, 29 are in turn activated by the pilot pressure 30*a*, 30*b* to the control valve 15.

In such a system, said further valve 25 to which the disconnection valve 24 provides a pilot pressure 31 can be one of said load holding valves. The load holding valve 25 is suitably arranged downstream the control valve 15 and upstream the actuator 18 with respect to the flow direction from the pump 13 to the hydraulic actuator 18. The valve 24 for disconnecting the flow of hydraulic fluid from the pump 13 to the hydraulic actuator 18 is arranged to provide a pilot pressure 31 to the load holding valve 25, thereby closing the load holding valve 25 and disconnecting the pump 13. If the control valve 15 is put in an active state by a pilot pressure 30*a* at the right side of the control valve 15, the pump 13 is connected via the inlet valve 16*a* to the piston rod side 21 of the hydraulic cylinder 18 and the piston side 22 of the hydraulic cylinder 18 is connected to a return line 32 and to tank 23 via the outlet valve 17*a*. The disconnection valve 24 can then be controlled to establish a connection between the LS port 33 of the control valve 15 to one side (left side) of the load holding valve 25. Thus, the LS-pressure is acting on the left side of the load holding valve 25. At the same time, same pressure from the main line from the control valve 15 is acting on the other side (right side) of the load holding valve 25. In addition, a spring 34 is arranged on the left side of the load holding valve 25, and thereby the total force on the left side will be higher than the force on the right side of the load holding valve 25. Accordingly the load holding valve 25 will be closed and no hydraulic fluid will be allowed to flow from the pump 13 to the actuator 18.

Thus, by means of the disconnection valve 24 controlled by a control unit 35, the load holding valve 25 can be closed and the flow of hydraulic fluid from the pump 13 to the hydraulic cylinder 18 is disconnected.

A connection 36 between the left side of the loading valve 25 and the piston rod side 21 of the hydraulic cylinder 18 is arranged via the pilot valve 28 for the load holding valve 25. This line 36 is provided with a throttling valve 37 or restricted orifice. The purpose with the restricted orifice is to ensure that the pressure on the left side of the load holding valve 25 will be the same as the pump pressure if the pump pressure is higher than the pressure at the piston rod side 21 of the hydraulic cylinder 18.

When the pump 13 is disconnected, which means that no hydraulic fluid with high pressure is provided by the pump 13, another flow of hydraulic fluid has to be allowed to reach the hydraulic cylinder 18 for filling the chamber 21 of the hydraulic cylinder 18 and enabling movement of the piston rod 27 (without cavitation). For example, during lowering of a load 19 when the pump 13 is disconnected and the movement is caused by the weight of the load 19 (including any implement) only, a flow of hydraulic fluid to the piston rod side 21 of the hydraulic cylinder 18 is required. Such a flow can be provided from tank 23 or preferably from the return line 32 connected to tank 14. This filling of the hydraulic cylinder chamber can be performed via an anti-cavitation valve 38, such as a check valve. By means of a counter pressure valve 39 arranged on the return line 32, downstream the connection point 40 between the return line and the hydraulic cylinder with respect to a flow direction from the control valve 15 to tank 23, a pressure is created that facilitates the filling of the hydraulic cylinder chamber 21 during lowering of the load 19.

Although the hydraulic system 12 preferably comprises a variable pump 13 having a displacement that can be varied, other pumps could be used. The pump can for example be driven by an internal combustion engine or an electric motor. In the example embodiment illustrated, the variable pump 13 can receive an LS-signal 14 from the LS port 33 of the control valve 15, which LS-signal corresponds to the load pressure of the actuator 18.

The hydraulic system 12 preferably further comprises a valve 24 for preventing the LS-signal 14 based on the load on the hydraulic actuator 18 from reaching the pump 13 when the pump 13 is disconnected. In the example embodiment illustrated in FIG. 2, the valve 24 for preventing an LS-signal 14 based on the load on the hydraulic actuator from reaching the pump 13 when the pump is disconnected and said valve 24 for disconnecting the flow of hydraulic fluid from the pump 13 to the hydraulic actuator 18 provided that a determined load on the hydraulic actuator exceeds a threshold value, is one and the same valve 24. In other words; the disconnection valve 24, exemplified as a 3/2 solenoid valve, is used also to prevent the LS-signal 14 from reaching the pump 13. When the disconnection valve 24 is controlled to establish a connection between the LS port 33 of the control valve 15 and the left side of the load holding valve 25, the connection between the LS port 33 of the control valve 15 and the control device 41 or pressure regulator of the pump 13 is at the same time broken.

Thus, at the same time as the flow from the pump 13 is disconnected, the control signal 14 to the pump 13 is also disconnected. The pump 13 can receive another LS-signal 42 from any other function 43 or the pump 13 can be controlled by the control unit 35 to a stand by state, for instance.

The hydraulic system 12 comprises a means 44 for determining the load 19 on the hydraulic actuator 18. Although the load determining means preferably comprises a pressure sensor 44 arranged for measuring a hydraulic pressure indicating the load pressure of the hydraulic actuator and thereby the actual load on the actuator, other means for determining the mass or weight of the load can be used. For example strain gauges arranged at the actuator or at an implement or lifting arm controlled by the actuator can be used to determine the actual load on the actuator.

The actual load 19 on the actuator is compared to a threshold value for the load on the actuator 18 by means of the control unit 35. For loads below (or equal to) the threshold value the pump 13 is not disconnected, and for loads exceeding the threshold value the pump 13 is disconnected. The threshold value is usually not a fixed value, but will vary depending on the current machine, the actuator (for example for tilt or lift function), the operation to be performed etc. The threshold value could also be dependent on other parameters.

The threshold value is suitably selected such that sufficient lowering velocity can be obtained even when the pump 13 is disconnected. In other words; the load threshold value can be dependent on the requested velocity of the hydraulic actuator 18. The requested velocity of the hydraulic actuator 18 is usually generated from an operator lever 45. For example, the requested velocity indicates the desired velocity for lowering an implement movable by the hydraulic actuator 18. This movement can be lowering of an arm to which the implement is attached or lowering of the implement, such as a bucket, by tilting the implement.

As regards the lifting arm of a wheel loader, the load threshold value is preferably lower than the pressure at the piston side when there is no load in the bucket. For example, the pressure at the piston side with an unloaded bucket can be 40-60 bar (depending on the lift height) due to the dead load of the implement (bucket) and the lift arm. Therefore, for many wheel loaders a pressure in the range 20-50 bar, preferably 30-40 bar is suitable as threshold value.

As regards the tilt function of a wheel loader, the dead load is relatively small. However, in a load cycle the bucket is filled before unloading by tilting the bucket. At the start of the unloading, the pressure is relatively low due to the tilt angle of the bucket. Therefore pump pressure is needed at the start of the unloading, but when the bucket is tilted and reaches an "over centre" position, the pressure is increased and the pump can be disconnected. The threshold value can be for example in the range 30-50 bar.

All features and variants discussed hereinabove with reference to the hydraulic system 12 can be applied partly or entirely to the control unit and/or the method according to the invention described hereinafter.

Figure 3:
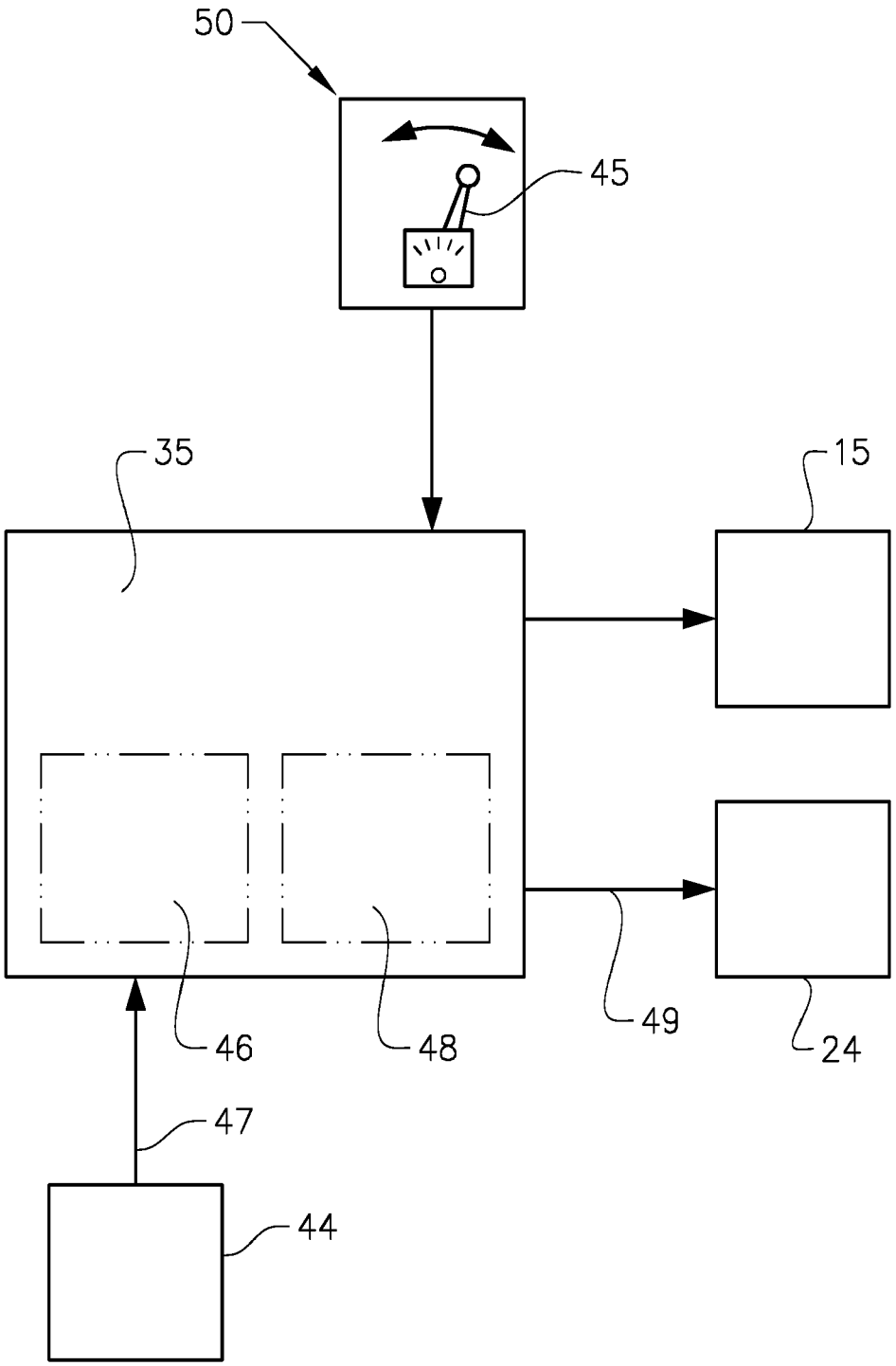
FIG. 3 shows one embodiment of the control unit according to the invention.

As mentioned, the invention also relates to a control unit 35. In FIG. 3 one embodiment of the control unit 35 according to the invention is shown. For the features of the hydraulic system 12 described in connection with the control unit reference is made also to FIG. 2. Only features and functions unique for the control unit 35 will be described in detail. Same reference numerals used in FIG. 3 as in FIG. 2 will indicate same or similar components as already described with reference to FIG. 2, and hereinafter some of these components will only be briefly described or not described at all.

The control unit 35 comprises a pressure control module 46 for receiving a signal 47 indicative of a load 19 on the hydraulic actuator 18, and a valve control module 48 for transmitting a signal 49 for controlling a valve 24 to disconnect the flow of hydraulic fluid from the pump 13 to the hydraulic actuator 18, while allowing another flow of hydraulic fluid to the hydraulic actuator, provided that an indicated load on the actuator exceeds a threshold value. The valve control module 48 is preferably arranged to transmit a signal 49 for preventing an LS-signal based on the load on the hydraulic actuator 18 from reaching the pump 13 when the pump is disconnected.

The control unit 35 is suitably connected to some kind of operator input means 50, such as an operator lever 45. As a response to an operator request the control unit 35 controls the control valve 15 and the control valve 15 is opened to provide hydraulic fluid from the pump 13 to the actuator 18 as described hereinabove with reference to FIG. 2. The hydraulic system 12 may comprise a pressure sensor 44 for measuring the load pressure of the hydraulic cylinder 18. A signal 47 corresponding to the load pressure measured by the pressure sensor 44 can be transmitted to the control unit 35. The control unit 35 can be a part of a main control unit or a separate unit that communicates with the main control unit.

The invention also relates to a method for controlling a hydraulic system. Although the method will be described herein with reference to the flowchart in FIG. 4, the method may further include or use any of the other features described hereinabove, particularly with reference to FIGS. 1 and 2. For the components of the hydraulic system reference numerals associated with FIG. 2 will be used.

The method according to the invention comprises determining a load 19 on the hydraulic actuator 18, controlling a valve 24 to disconnect the flow of hydraulic fluid from the pump 13 to the hydraulic actuator 18, while allowing another flow of hydraulic fluid to the hydraulic actuator 18, provided that the determined load on the hydraulic actuator 18 exceeds a threshold value.

The method preferably comprises preventing an LS-signal 14 based on the load on the hydraulic actuator from reaching the pump 13 when the pump is disconnected. The method can be applied to a hydraulic system during lowering of an implement movable by the hydraulic actuator 18.

Figure 4:
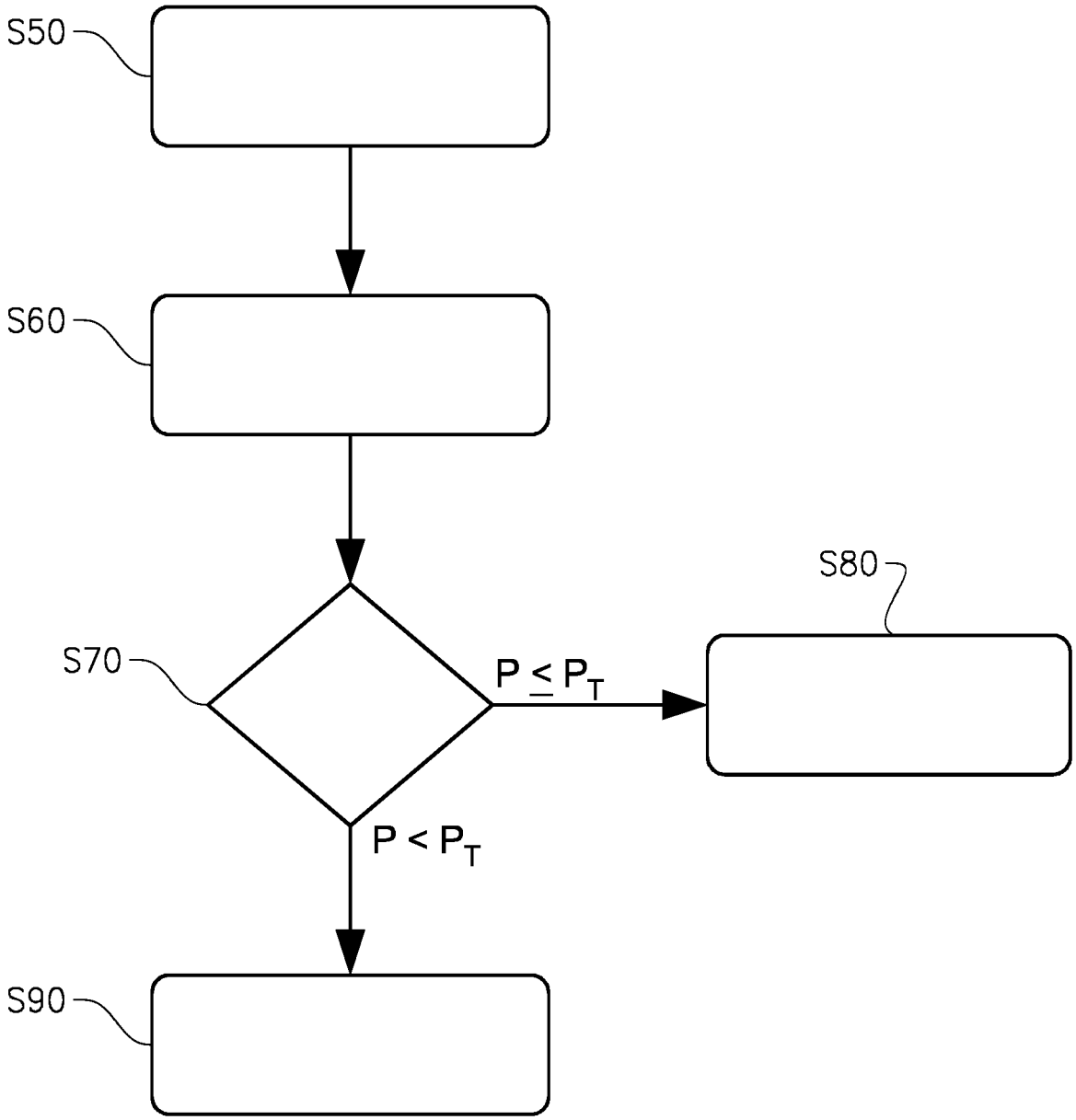
FIG. 4 is a flowchart of one embodiment of the method according to the invention.

The method applied on the hydraulic system 12 described with reference to FIG. 4 and FIG. 2, can be performed as disclosed below.

An operator is activating a lowering lever 45 for lowering the implement. In a first step S50, the control unit 35 receives a signal indicating the lever position. In a second step S60, the control unit 35 receives a signal from the pressure sensor 44 indicating the load on the actuator 18. In the next step S70, the determined load pressure P is compared to a threshold value PT. If the load pressure is lower than (or equal to) the predetermined threshold value PT, which threshold value can be for example 30 bar, corresponding to a certain load, then the pump 13 will not be disconnected and the lowering operation will be the same as in a conventional system, i.e. performed with pressurized hydraulic fluid provided from the pump, in step S80. A low pressure at the piston side 22 of the hydraulic cylinder 18 indicates that the hydraulic cylinder is subjected to a low load 19 which may not be sufficient to drive the piston 27 of hydraulic cylinder down without pressurized fluid from the pump 13.

If on the other hand the pressure P from the pressure sensor 44 is higher than the predetermined threshold value PT, then the pump 13 will be disconnected and the lowering operation will be performed without supplying hydraulic fluid from the pump 13 to the actuator 18. In step S90, the control unit 35 activates the disconnection valve 24. The pilot pressure 30*a* on the right side of the control valve 15 will increase and the control valve 15 opens the LS port 33 to the disconnection valve 24 and further to the left side of the load holding valve 25. The force on the left side of the load holding valve will be higher than on the right side of the loading valve which makes the load holding valve 25 to be closed. The pilot pressure on the right side of the load holding valve is the pump pressure. The pressure on the left side of the load holding valve will be the highest pressure of the pump pressure and the pressure from the piston rod side of the hydraulic cylinder. In addition, the force on the left side of the load holding valve 25 includes the force generating by the spring 34, thereby ensuring that the force on the left side exceeding the force on the right side of the load holding valve 25.

At the same time as the pump is disconnected when the disconnection valve 24 is activated, the disconnection valve 24 also prevents the LS signal 14 from the LS port 33 of the control valve 15 from reaching the pressure regulator 41 of the pump 13. The pump will instead be brought into a stand by state providing a certain pressure which is called stand by pressure. If another function 43 (actuator) is used at the same time, the LS-signal 42 from this function will activate the pump 13 to increase the pressure according to the load pressure of this function. The pump 13 will however not supply the first function 18 because of the closed load holding valve 25.

The flow from the piston side 22 of the hydraulic cylinder 18 is passing the right load holding valve 26 and the flow is controlled by the outlet valve 17*a* of the control valve 15.

A flow of hydraulic fluid to the hydraulic actuator 18 is allowed for filling the piston rod side 21 of the hydraulic cylinder 18. This flow is available from the return line 32 when the piston rod 27 is moved due to the mass of the load on the actuator 18. The counter pressure valve 39 increases the pressure of the return flow to a certain pressure level (for example about 5 bar) which makes it possible to fill the piston rod side 21 of the hydraulic cylinder 18 with hydraulic fluid via the check valve 38 functioning as an anti-cavitation valve. Some of the hydraulic fluid from the outlet valve 17*a* of the control valve 15 will go the tank 23 because the chamber of the piston side 22 of the hydraulic cylinder is bigger than the chamber of the piston rod side 21 of the hydraulic cylinder 18.

It is to be understood that the present invention is not limited to the embodiments described above and illustrated in the drawings; rather, the skilled person will recognize that many changes and modifications may be made within the scope of the appended claims.

The invention claimed is:

1. A hydraulic system for a working machine, the hydraulic system being a load sensing system and comprising a hydraulic actuator for movement of an implement and a control valve having an inlet valve and an outlet valve for controlling the flow of hydraulic fluid from a pump to the hydraulic actuator and for draining hydraulic fluid from the hydraulic actuator, respectively, and a means for determining the load on the hydraulic actuator, wherein the hydraulic system comprises a valve for disconnecting the flow of hydraulic fluid from the pump to the hydraulic actuator, while allowing another flow of hydraulic fluid to the hydraulic actuator, provided that the determined load on the hydraulic actuator exceeds a threshold value, wherein the hydraulic system comprises a valve for preventing an LS-signal based on the load on the hydraulic actuator from reaching the pump when the pump is disconnected, wherein the valve for preventing an LS-signal based on the load on the hydraulic actuator from reaching the pump when the pump is disconnected and the valve for disconnecting the flow of hydraulic fluid from the pump to the hydraulic actuator provided that a determined load on the hydraulic actuator exceeds a threshold value, is one and the same valve.

2. The hydraulic system according to claim 1, wherein the hydraulic system comprises a load holding valve arranged downstream the control valve and upstream the hydraulic actuator with respect to the flow direction from the pump to the hydraulic actuator, and the valve for disconnecting the flow of hydraulic fluid from the pump to the hydraulic actuator is arranged to provide a pilot pressure to the load holding valve, thereby closing the load holding valve and disconnecting the pump.

3. The hydraulic system according to claim 1, wherein the inlet valve and the outlet valve are integrated in the same spool of the control valve.

4. The hydraulic system according to claim 1, wherein the load determining means comprises a pressure sensor arranged for measuring a hydraulic pressure indicating the load pressure of the hydraulic actuator.

5. The hydraulic system according to claim 1, wherein the threshold value is calculate d based on a signal indicating requested velocity of the hydraulic actuator.

6. The hydraulic system according to claim 5, wherein the signal indicating requested velocity of the hydraulic actuator is generated from an operator input means.

7. The hydraulic system according to claim 5, wherein the signal indicates requested velocity of the hydraulic actuator for lowering the implement.

8. The hydraulic system according to claim 1, wherein the threshold value is selected to be lower than the load caused on the actuator by the dead load acting on the actuator.

9. A working machine comprising the hydraulic system according to claim 1.

10. A method for controlling a hydraulic system, the hydraulic system being a load sensing system and comprising a hydraulic actuator for movement of an implement and a control valve having an inlet valve and an outlet valve for controlling the flow of hydraulic fluid from a pump to the hydraulic actuator and for draining hydraulic fluid from the hydraulic actuator, respectively, the method comprising determining a load on the hydraulic actuator, controlling a valve to disconnect the flow of hydraulic fluid from the pump to the hydraulic actuator, while allowing another flow of hydraulic fluid to the hydraulic actuator provided that the determined load on the hydraulic actuator exceeds a threshold value, and preventing an LS-signal based on the load on the hydraulic actuator from reaching the pump when the pump is disconnected.

11. A method according to claim 10, comprising controlling the hydraulic system during lowering of the implement movable by the hydraulic actuator.

12. A non-transitory computer readable medium comprising a computer program for performing the method of claim 10 when the program is run on a computer.

13. A control unit for controlling a hydraulic system, the hydraulic system being a load sensing system and comprising a hydraulic actuator for movement of an implement and a control valve having an inlet valve and an outlet valve for controlling the flow of hydraulic fluid from a pump to the hydraulic actuator and for draining hydraulic fluid from the actuator, respectively, and a means for determining the load on the hydraulic actuator, wherein the control unit comprises a pressure control module for receiving a signal indicative of a load on the hydraulic actuator, and a valve control module for transmitting a signal for controlling a valve to disconnect the flow of hydraulic fluid from the pump to the hydraulic actuator, while allowing another flow of hydraulic fluid to the hydraulic actuator, provided that an indicated load on the actuator exceeds a threshold value, wherein the valve control module is arranged to transmit a signal for preventing an LS-signal based on the load on the hydraulic actuator from reaching the pump when the pump is disconnected.

* * * * *